United States Patent [19]

Deutsch

[11] Patent Number: 4,656,912

[45] Date of Patent: Apr. 14, 1987

[54] TONE SYNTHESIS USING HARMONIC TIME SERIES MODULATION

[75] Inventor: Ralph Deutsch, Sherman Oaks, Calif.

[73] Assignee: Kawai Musical Instrument Mfg. Co., Ltd., Hamamatsu, Japan

[21] Appl. No.: 781,361

[22] Filed: Sep. 30, 1985

[51] Int. Cl.[4] ..... G10H 1/08; G10H 7/00

[52] U.S. Cl. ..... 84/1.22; 84/1.01

[58] Field of Search ..... 84/1.01, 1.22–1.24

[56] References Cited

U.S. PATENT DOCUMENTS

| | | | |
|---|---|---|---|
| 4,453,441 | 6/1984 | Deutsch | 84/1.22 |
| 4,461,200 | 7/1984 | Kitagawa | 84/1.22 X |
| 4,485,717 | 12/1984 | Kitagawa | 84/1.22 |

*Primary Examiner*—S. J. Witkowski

*Attorney, Agent, or Firm*—Ralph Deutsch

[57] ABSTRACT

A keyboard operated electronic musical instrument is disclosed which has a number of tone generators that are assigned to actuated keyswitches. Musical tones are produced by computing a master data set which defines the data points corresponding to a period of a musical waveshape. The master data set points are read out sequentially and repetitively from a memory and converted into an audible musical tone. Circuitry is provided whereby the master data set is computed from a time sequence of harmonic coefficients which is modulated to produce a musical tone having a time variant spectra.

6 Claims, 3 Drawing Figures

TONE SYNTHESIS USING HARMONIC TIME SERIES MODULATION

BACKGROUND OF THE INVENTION

1. Field of the Invention

This invention relates to musical tone synthesis and in particular is concerned with an improvement for producing tones having a time variant spectral content.

2. Description of the Prior Art

In various methods employed to generate new varieties of musical tone, the underlying technique is a means for varying the spectral components of tone as a function of time. Musical tone generators of the type in which a waveshape rich in harmonics is passed through a sliding formant filter to produce a time-varying tonal effect by altering the relative strength of the harmonics are well known in the musical tone generation art. In analog signal tone generators, the sliding formant filter is generally implemented as a high pass or a low pass filter in which the cutoff frequency may be varied with time to alter the harmonic content of the musical waveshape at the output of the filter. In digital tone generation systems the equivalent effect of a sliding formant filter can be achieved by scaling the harmonic coefficients that are used in a computational algorithm to obtain the successive amplitude point values of the musical waveshape. Digital musical tone generation of this type are described in U.S. Pat. No. 3,956,960 entitled "Formant Filtering In A Computor Organ" and in U.S. Pat. No. 4,085,644 entitled "Polyphonic Tone Synthesizer."

Frequency modulation techniques have been incorporated into musical tone generators to obtain waveshapes with time variant spectral components. These systems employ the known characteristic that the side bands of a frequency modulated carrier frequency form overtones when the fundamental frequency of the tone corresponds to the modulation frequency. The application of frequency modulation techniques is described in the article "The Synthesis of Complex Audio Spectra by Means of Frequency Modulation," by J. M. Chowning, J. Aud. Eng. Soc., Vol. 21, No. 7, September 1973, pp 526–534. Also in U.S. Pat. No. 4,018,121 there is described a digital system for implementing a frequency modulation system to generate unique musical sounds.

In U.S. Pat. No. 4,175,644 entitled "Musical Tone Generator With Time Variant Overtones" a tone generator is described which incorporates a frequency modulation calculation into the calculation of the master data set used in the musical tone generation system described in U.S. Pat. No. 4,085,644 entitled "Polyphonic Tone Synthesizer." In this system the address for reading out trigonometric sinusoid function values from a sinusoid table are changed as a function of time in a periodic or sinusoidal fashion. The effect is to produce a sequence of sinusoidal value from the table which correspond to a series of points on a frequency modulated carrier signal.

SUMMARY OF THE INVENTION

In a Polyphonic Tone synthesizer of the type described in U.S. Pat. No. 4,085,644 a computation cycle and a data transfer cycle are repetitively and independently implemented to provide data which are converted into musical waveshapes. A sequence of computation cycles is implemented during each of which a master data set is created. The master data set comprises a set of data points which define a period of a musical waveshape.

The master data set is computed using an equivalent time sequence of harmonic coefficients which are derived from a memory storing a preselected set of harmonic coefficients. These harmonic coefficients are read out sequentially to form a time series of harmonic coefficients. This time series of harmonic coefficients is modulated in a fashion to produce master data sets which create musical tones having a time variant spectra.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

The present invention is directed towards an improvement in the tone quality produced by a system described in detail in U.S. Pat. No. 4,085,644 entitled Polyphonic Tone Synthesizer. This patent is hereby incorporated by reference. In the following description all elements of the system which are described in the referenced patent are identified by two digit numbers which correspond to the same numbered elements appearing in the referenced U.S. Pat. No. 4,085,644.

Figure 1:
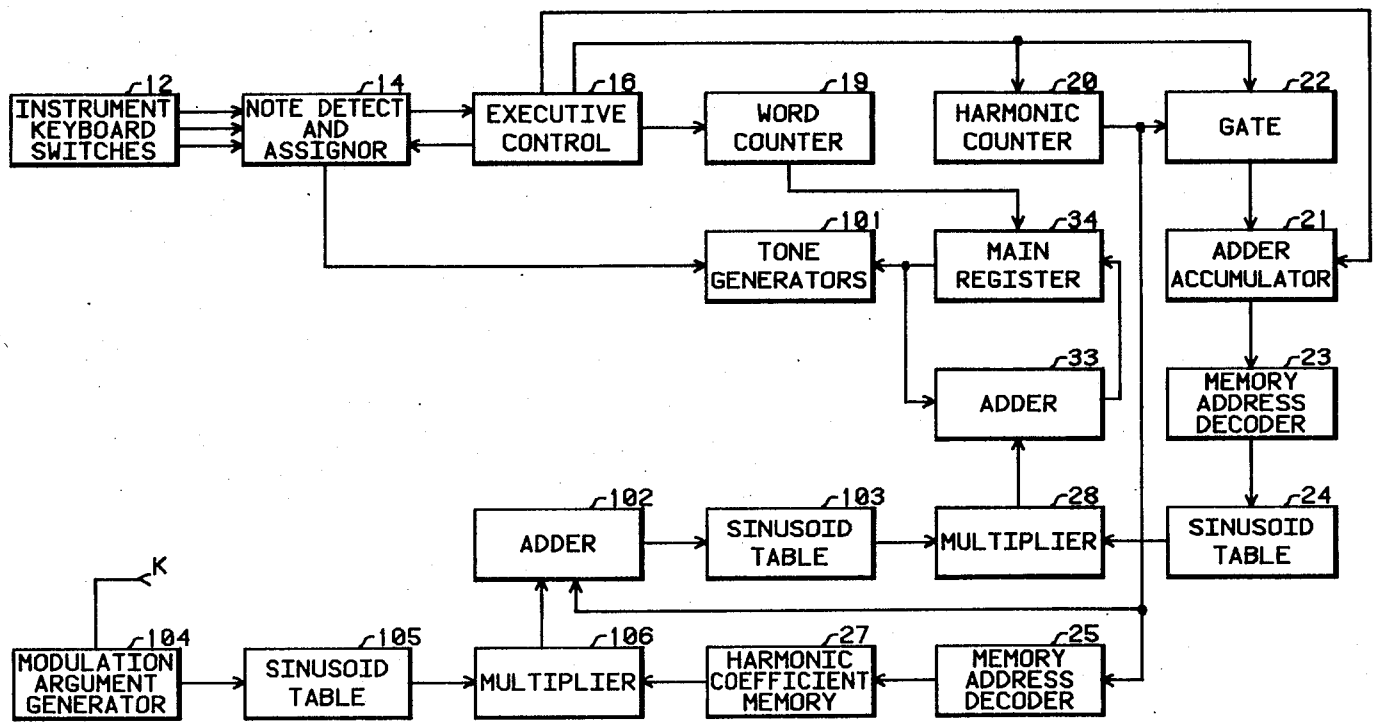
FIG. 1 is a system diagram of the musical waveform generator.

FIG. 1 shows an embodiment of the present invention which is described as a modification and adjunct to the system described in the referenced U.S. Pat. No. 4,085,644. The preferred embodiment is one in which a computation cycle is initiated to compute a master data set which is then transferred to a note register associated with a single assigned tone generator. As soon as the transfer of the master data set is completed, a second computation cycle is immediately started to compute an independent master data set for a second assigned tone generator. This sequence of a computation cycle followed by a transfer cycle is continued until a new master data set has been computed and transferred to each of the assigned tone generators. At this time the complete computation and transfer process is repeated so that each of the tone generators is individually and continuously supplied with constantly updated independent master data sets. This operation sequence permits an independent time varying tone to be implemented for the subset of assigned tone generators.

As described in the above referenced patent, the Polyphonic Tone Synthesizer includes an array of instrument keyboard switches 12. If one or more of the keyboard switches has a switch status change and is actuated ("on" switch position), the note detect and assignor 14 encodes the detected keyboard switch having the status change to an actuated state and stores the corresponding note information for the actuated key switches. A tone generator, contained in the system block labeled tone generators 101, is assigned to each actuated keyswitch using information generated by the note detect and assignor 14.

A suitable configuration for a note detect and assignor subsystem is described in U.S. Pat. No. 4,022,098. This patent is hereby incorporated by reference.

As described in the referenced U.S. Pat. No. 4,085,644 the harmonic counter 20 is initialized to its minimal, or zero count, state at the start of each computation cycle. Each time that the word counter 19, which is incremented by the executive control 16, returns to its minimal, or zero, count state because of its modulo counting implementation, a signal is generated by the executive control 16 which is used to increment the count state of the harmonic counter 20. The word counter 19 is implemented to count modulo 64 which is the number of data words comprising a master data set. The harmonic counter 20 is implemented to count modulo 32 which number is equal to the maximum number of harmonics corresponding to the number of data words in a master data set which determine the equally spaced points for a period of the generated musical tone.

At the start of each computation cycle, the accumulator in the adder-accumulator 21 is initialized to a zero value by the executive control 16. Each time that the word counter 19 is incremented, the adder-accumulator 21 adds the current count state of the harmonic counter 20 to the sum contained in the accumulator. This addition is implemented to be modulo 64.

The content of the accumulator in the adder-accumulator 21 is used by the memory address decoder 23 to access trigonometric function values from the sinusoid table 24. The sinusoid table 24 is advantageously implemented as a read only memory storing values of the trigonometric function sin $(2\pi\theta/64)$ for $0 \leqq \theta \leqq 64$ at intervals of D. D is a table resolution constant.

The memory address decoder 25 is used to read out harmonic coefficients stored in the harmonic coefficient memory 27. In this manner the read out harmonic coefficients constitute a time sequence of harmonic coefficients.

The modulation argument generator 104 is used to provide a modulation parameter number k. The preselected modulation parameter k is generally created as a time variant parameter so the musical waveshapes generated by the tone generating system will have spectra which vary with time.

The value of the modulation frequency number k is used to address out trigonometric function values stored in the sinusoid table 105. The sinusoid table 105 is implemented as a read only memory storing values of the trigonometric function sin $(2\pi\theta/M)$ for $0 \leqq \theta \leqq M$ at intervals of G. G is a table resolution constant and M is a preselected number which determines the periodicity of the trigonometric functions read out from the sinusoid table 105.

The multiplier 106 is used to multiply the harmonic coefficients read out from the harmonic coefficient memory 27 by the trigonometric function values read out from the sinusoid table 105 to form an argument product value.

The adder 102 multiplies the count state q of the harmonic counter 20 by the constant $2\pi/N$ and adds the result to the argument product value provided by the multiplier 106. $N=64$ is the number of data words contained in the master data set. The output of the adder 102 is used to read out trigonometric function values stored in the sinusoid table 103. The read out values form an equivalent time sequence of harmonic coefficients.

The sinusoid table 103 is implemented as a read only memory storing values of the trigonometric function sin $(2\pi\theta/N)$ for $0 \leqq \theta \leqq N$ at intervals of D. D is a table resolution constant.

The combination of the modulation argument generator 104, sinusoid table 105, multiplier 106, adder 102, and sinusoid table 103 constitute a modulation means for modulating the time sequence of harmonic coefficients read out from the harmonic coefficient memory 27.

The multiplier 28 multiplies the trigonometric function value read out from the sinusoid table 24 by the trigonometric function value read out from the sinusoid table 103.

During a computation cycle master data set words are read out from the main register 34 in response to the count state of the word counter 19. The read out master data values are added to the product value produced by the multiplier 28 by means of the adder 33. The summed values are then stored in the main register 34 at the same address from which the original data value had been read. The end of a computation cycle occurs when both the word counter 19 and the harmonic counter 20 have attained their respective maximum count states. At this time a complete master data set has been computed and is stored in the main register 34.

As described in the referenced U.S. Pat. No. 4,085,644 the data values $z_n$ for a master data set are computed according to a relation of the form $$z_n = \sum_{q=1}^{N/2} c_q \sin(2\pi nq/N);\ n = 1, 2, \ldots, N = 64 \qquad \text{Eq. 1}$$

In the present invention shown in FIG. 1, the master data set is computed from a generalized relation having the form $$x_n = \sum_{q=1}^{N/2} H_q \sin(2\pi nq/N) \qquad \text{Eq. 2}$$

where the generalized harmonic coefficient sequence term is given by the relation
where $$H_q = \sin(2\pi q/N + c_q \sin(2\pi k/M) \qquad \text{Eq. 3}$$

$c_q$ represents the q'th harmonic coefficient read out of the harmonic coefficient memory 27. The term $c_q$ sin $(2\pi k/M)$ is generated by the multiplier 106 and the trigonometric function value sin $(2\pi k/M)$ which is read out from the sinusoid table 105 in response to the value of k provided by the modulation argument generator 104.

The expression for $H_q$ can be expanded into a series of harmonic terms by using the mathematical identity $$\sin(\theta + a\sin\beta) = J_0(a)\sin\theta + \sum_{j=1}^{\infty} J_j(a)[\sin(\theta + j\beta) + (-1)^k \sin(\theta - j\beta)] \qquad \text{Eq. 4}$$

$J_j(a)$ represents a Bessel function of order j and argument a.

Make the following substitutions in Eq. 3 and Eq. 4.

$$\theta = 2\,q/N \qquad \text{Eq. 5}$$

$$a = c_q$$

-continued $$\beta = 2\pi k/M$$

The result is $$H_q = J_0(c_q) + J_1(c_q)[\sin(2\pi q/N + 2\pi k/M) - \sin(2\pi q/N - 2\pi k/M] + J_2(c_q)[\sin(2\pi q/N + 4\pi k/M) - \sin(2\pi q/N - 4\pi k/M)] + J_3(c_q)[\sin(2\pi q/N + 6\pi k/M) - \sin(2\pi q/N - 6\pi k/M)] + \quad \text{Eq. 6}$$

Applying the trigonometric identities for the sum and differences in a sinusoid argument and combining the result with Eq. 2 yields the form $$x_n = \sum_{q=1}^{N/2} \{J_0(c_q)\sin(2\pi nq/N) + J_1(c_q)\sin 2\pi k/M\sin(4\pi nq/N) + J_2(c_q)\cos 4\pi k/M(1 - \cos(4\pi nq/N)) + J_3(c_q)\sin 6\pi k/M\sin(4\pi nq/N) + J_4(c_q)\cos 8\pi k/M(1 - \cos(4\pi nq/N)) + \ldots + J_r(c_q)\sin 6\pi rk/M\sin(4\pi nq/N) + J_s(c_q)\cos 8\pi sk/M(1 - \cos(4\pi nq/N)) + \ldots\} \quad \text{Eq. 7}$$

where r is an odd integer and s in an even integer.

An important system operational characteristic distinguishes the application of the present invention applied to the Polyphonic Tone Synthesizer from other types of musical tone generators. The relation shown in Eq. 4 indicates the general property that the frequency modulation of a time series produces a theoretical spectra containing an infinite number of harmonics. While such an extended range of harmonics may be acceptable for analog musical tone generators, an infinite extended range of harmonics is usually almost fatal in digital musical tone generation systems. In digital tone generators, a digital-to-analog converter is used to convert a sequence of digital data words into analog musical waveshapes. The converter generally is operated at a fixed conversion frequency rate. If a very large number of spectral components are present in the sequence of digital data words to be converted as indicated by Eq. 7, then spectral or aliasing of the spectra will occur. The result is the presence of objectionable frequency components that lie below the fundamental frequency of the generated musical tone. Since the aliased frequency components are no longer either true harmonics or sub harmonics they sound as if they were noise components accompanying the musical tone.

Such spectral folding cannot occur with the preferred embodiment of the present inventive system. The process of computing a master data set containing a fixed number of data points, the transfer of the master data set to a note register, and the reading out and converting data from the note register eliminates any possible spread of the harmonic components beyond a number equal to one-half of the number of data points in the master data set. Moreover the tone generation process prevents any spectral folding as well as to produce musical tones having only true harmonics of the fundamental frequency.

Figure 2:
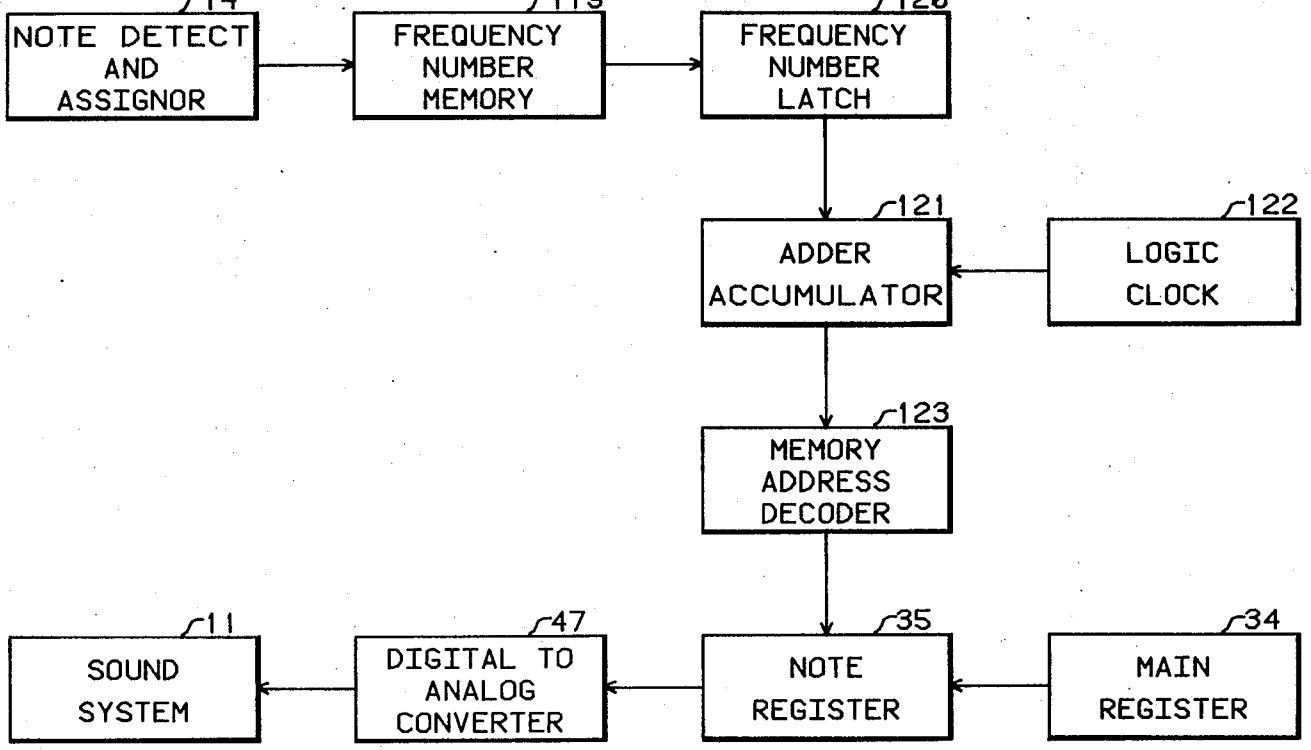
FIG. 2 is a system diagram of a tone generator.

FIG. 2 shows the system logic for a tone generator. Although FIG. 2 only explicitly shows a single tone generator, it is evident from the description that the elements can be replicated to provide for any desired number of tone generators.

When the note detect and assignor 14 detects that a keyboard switch has been actuated, a corresponding frequency number is read from the frequency number memory 119. The frequency number memory 119 can be implemented as a read-only addressable memory (ROM) containing data words stored in binary numeric format having values $2^{-(M-n)/12}$ where N has the range of values N=1,2, . . . ,M and M is equal to the number of keyswitches on the musical instrument's keyboard. n is the keyswitch note number which designates a keyswitch and is counted in ascending order from the lowest frequency keyswitch on the keyboard. The frequency numbers represent the ratios of frequencies of generated musical tones with respect to the frequency of the system's logic clock. A detailed description of frequency numbers is contained in U.S. Pat. No. 4,114,496 entitled "Note Frequency Generator For A Polyphonic Tone Synthesizer." This patent is hereby incorporated by reference.

The frequency number read out of the frequency number memory 119 is stored in the frequency number latch 120. In response to timing signals produced by the logic clock 122, the frequency number contained in the frequency number latch 120 is successively added to the content of the accumulator in the adder-accumulator 121. The content of the accumulator is the accumulated sum of a frequency number.

During the transfer cycle associated with the tone generator shown explicitly in FIG. 2, the master data set contained in the main register 34 is copied into the note or waveshape memory 35. In response to the most significant bits of the accumulated frequency number contained in the adder-accumulator 121, the memory address decoder 123 reads out master data words from the note register 35. This memory read out is implemented to be modulo the number of memory addresses contained in the note register 35.

The master data set values read out from the note register 35 are converted into an analog signal by means of the digital-to-analog converter 47. The resulting analog signal is converted into a musical sound by means of the sound system 11 which consists of an amplifier and speaker combination.

A variety of different tonal effects can be obtained by varying the parameter k/M which appears in Eq. 3. Further tone effects can be obtained by varying the term q/N which also appears in Eq. 3. The value of k is supplied as an input parameter to the modulation argument generator 104. The modulation argument generator 104 multiplies the input value of k by $2\pi/M$ to produce the output argument $2\pi k/M$ which is used to address out trigonometric values from the sinusoid table 105. The input value of k can be readily implemented to be a time variant parameter value.

Figure 3:
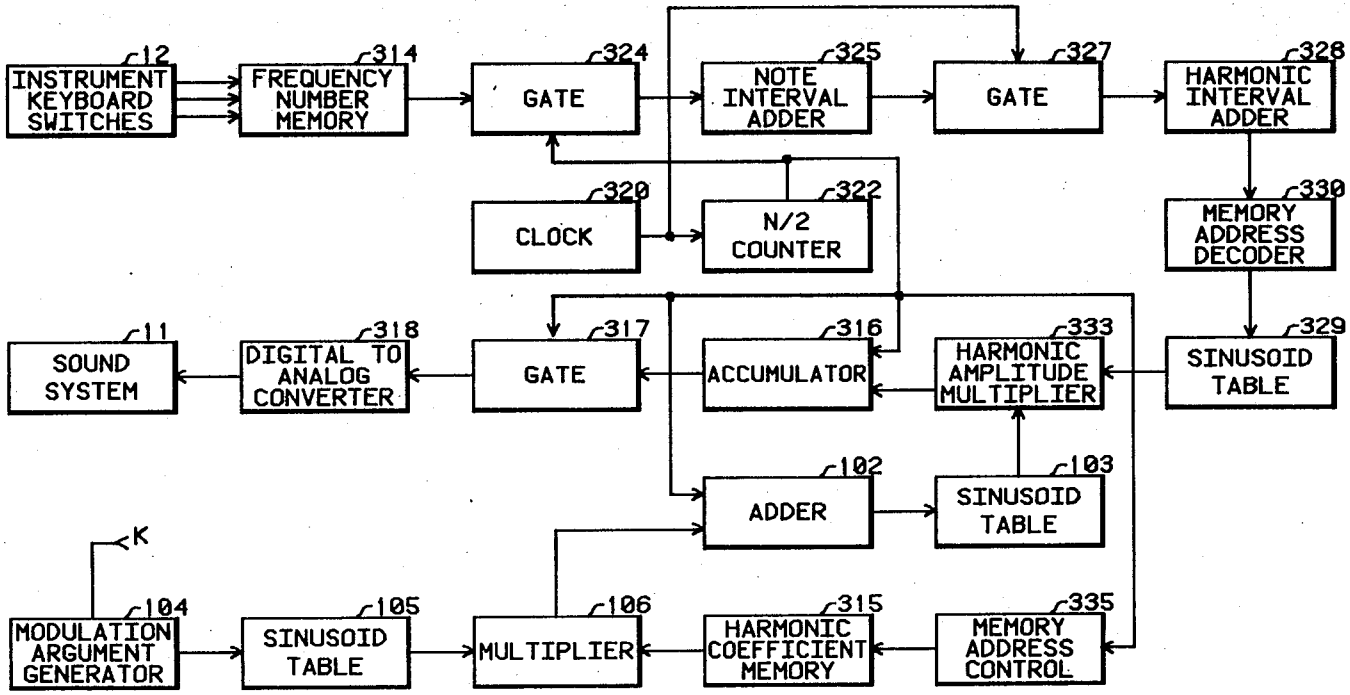
FIG. 3 is a system block diagram of an alternate system implementation.

The present invention is not limited to a musical tone generator of the type described in the referenced U.S. Pat. No. 4,085,644. It can be incorporated into any tone generator of the generic type in which a generalized Fourier transform is used to compute a sequence of waveshape points from a set of harmonic coefficients. FIG. 3 illustrates an incorporation of the present invention into a tone generator of the type described in U.S. Pat. No. 3,809,786 entitled Computor Organ.

The system blocks shown in FIG. 3 having a three hundred series number correspond to the same blocks that appear in FIG. 1 of U.S. Pat. No. 3,809,786 which have the same last two digits.

A closure of a keyswitch contained in the block labeled instrument keyboard switches 12 causes a corresponding frequency number to be accessed out of the frequency number memory 314. The frequency number transferred via gate 324 is repetitively added to the contents of the note interval adder 325 at a rate determined by the changes in the count state of the N/2 counter 322. The content of the note interval adder 325 specifies the sample point on a musical waveshape that is to be computed.

For each output musical waveshape sample point, the amplitudes of a number of harmonic components are individually calculated by multiplying equivalent harmonic coefficients furnished by the sinusoid table 103 with trigonometric values read out of the sinusoid table 329. This multiplication is performed by the harmonic amplitude multiplier 333. The resultant harmonic components are summed algebraically by means of the accumulator 316 to obtain the net amplitude at the waveshape sample point corresponding to the content of the note interval adder 325. The detail of this calculation are described in the referenced U.S. Pat. No. 3,809,786.

The waveshape sample points contained in the accumulator 316 are converted into analog signals by means of the digital-to-analog converter 318. The output analog signal is furnished to the sound system 11 which transforms the signal into an audible musical tone.

The equivalent harmonic coefficients furnished by the sinusoid table 103 are created from the harmonic coefficients stored in the harmonic coefficient memory are created in a fashion analogous to that used in the system shown in FIG. 1 and previously described.

I claim:

1. In combination with a musical instrument in which a plurality of data words corresponding to the amplitudes of evenly spaced points defining the waveform of a musical tone are computed in a sequence of computation cycles from a preselected set of harmonic coefficients and are transferred sequentially and converted into musical waveshapes at a rate proportional to the pitch of the musical tone being generated, apparatus for producing a musical tone having a time variant spectra comprising;

a harmonic coefficient memory means for storing said preselected set of harmonic coefficients, a harmonic memory reading means whereby said preselected set of harmonic coefficients are read out sequentially from said harmonic coefficient memory means to produce a time sequence of harmonic coefficients, a harmonic coefficient modulation means whereby said time sequence of harmonic coefficients are modulated in a time variant manner to produce an equivalent time sequence of harmonic coefficients, a waveshape memory means for storing a plurality of data points a computing means responsive to said equivalent time sequence of harmonic coefficients whereby said amplitudes of evenly spaced points defining said waveform of a musical tone are computed and stored in said waveshape memory means, a waveshape reading means whereby said data points are sequentially and repetitively read out of said waveshape memory means, and a means for producing musical tones responsive to waveshape data points read out from said waveshape memory means thereby producing said musical tone having a time variant spectra.

2. In a musical instrument according to claim 1 wherein said computing means comprises;

a logic clock means for providing logic timing signals, a word counter for counting said logic timing signals modulo the number of data points stored in said waveshape memory means, and a harmonic counter incremented each time said word counter returns to its minimal count state whereby the count states of said harmonic counter constitute a time sequence of memory address numbers and wherein said harmonic counter counts modulo the number of said preselected set of harmonic coefficients stored in said harmonic coefficient memory means.

3. In a musical instrument according to claim 2 wherein said harmonic memory reading means comprises;

a harmonic address decoder responsive to said time sequence of memory address numbers whereby a time sequence of harmonic coefficients is read out from harmonic coefficient memory means.

4. In combination with a musical instrument in which a plurality of data words corresponding to the amplitudes of evenly spaced points defining the waveform of a musical tone are computed in a sequence of computation cycles from a preselected set of harmonic coefficients and are transferred sequentially and converted into musical waveshapes at a rate proportional to the pitch of the musical tone being generated, apparatus for producing a musical tone having a time variant spectra comprising;

a harmonic coefficient memory means for storing said preselected set of harmonic coefficients, a waveshape memory means for storing a plurality of data points, a logic clock means for providing logic timing signals, a word counter for counting said logic timing signals modulo the number of data points stored in said waveshape memory means, a harmonic counter incremented each time said word counter returns to its minimal count state whereby the count states of said harmonic counter constitute a time sequence of memory address numbers and wherein said harmonic counter counts modulo the number of said preselected set of harmonic coefficients stored in said harmonic coefficient memory means, a harmonic address decoder responsive to said time sequence of memory address numbers whereby a time sequence of harmonic coefficients is read out from harmonic coefficient memory means, a modulation argument generator wherein a modulation argument is generated in response to a preselected value of a modulation parameter, a first sinusoid table for storing a plurality of trigonometric sinusoid function values, a first sinusoid addressing means for reading out a trigonometric sinusoid function value from said first sinusoid table in response to said modulation argument, a multiplying means whereby said trigonometric sinusoid function value read out from said first sinusoid table is multiplied by one of said time sequence of harmonic coefficients to form a modulated time sequence of harmonic coefficients, an adder means for adding the count state of said harmonic counter to said modulated time sequence of harmonic coefficients to form a scaled modulated time sequence of harmonic coefficients, a second sinusoid table for storing a plurality of trigonometric sinusoid function values, a second sinusoid addressing means for reading out a trigonometric sinusoid function value from said second sinusoid table in response to each one of said scaled modulated time sequence of harmonic coefficients wherein said read out trigonometric function values constitute said equivalent time sequence of harmonic coefficients, a computing means responsive to said equivalent time sequence of harmonic coefficients whereby said amplitudes of evenly spaced points defining said waveform of a musical tone are computed and stored in said waveshape memory means, a waveshape reading means whereby said data points are sequentially and repetitively read out of said waveshape memory means, and a means for producing musical tones responsive to waveshape data points read out from said waveshape memory means thereby producing said musical tone having a time variant spectra.

5. In a musical instrument according to claim 4 wherein said computing means further comprises;

an adder-accumulator means comprising an accumulator wherein the count state of said harmonic counter is successively added to the content of an accumulator in response to said logic timing signals and wherein the content of said accumulator is initialized to a zero value at the start of each one of said sequence of computation cycles, a sinusoid table for storing a set of trigonometric sinusoid function values, a sinusoid table addressing means responsive to the content of said adder-accumulator means for reading out a trigonometric sinusoid function value from said sinusoid table, a harmonic multiplying means whereby said trigonometric sinusoid function value read out from said sinusoid table by one of said equivalent time sequence of harmonic coefficients to form an output product value, and a summing means whereby said output product value is added to a data word read out of said waveshape memory means and whereby the summed value is stored in said waveshape memory means at an address corresponding to the count state of said word counter.

6. In combination with a musical instrument in which musical waveshape data points are computed from a preselected set of harmonic coefficients, apparatus for producing a musical tone having a time variant spectra comprising;

a harmonic coefficient memory means for storing said preselected set of harmonic coefficients, a modulation argument generator wherein a modulation argument is generated in response to a preselected value of a modulation parameter, a first sinusoid table for storing a plurality of trigonometric sinusoid function values, a first sinusoid addressing means for reading out a trigonometric sinusoid function value from said first sinusoid table in response to said modulation argument, a multiplying means whereby said trigonometric sinusoid function value read out from said first sinusoid table is multiplied by one of said time sequence of harmonic coefficients to form a modulated time sequence of harmonic coefficients, an adder means for adding a harmonic number to said modulated time sequence of harmonic coefficients to form a scaled modulated time sequence of harmonic coefficients, a second sinusoid table for storing a plurality of trigonometric sinusoid function values, a second sinusoid addressing means for reading out a trigonometric sinusoid function value from said second sinusoid table in response to each one of said scaled modulated time sequence of harmonic coefficients wherein said read out trigonometric function values constitute an equivalent time sequence of harmonic coefficients, a computing means responsive to said equivalent time sequence of harmonic coefficients whereby said waveshape data points are computed which correspond to a musical tone having a time variant spectra, and a means for producing musical tones responsive to said computed waveshape data points.

* * * * *